United States Patent [19]

Furuichi et al.

[11] 4,222,660

[45] Sep. 16, 1980

[54] IMAGE FORMING DEVICE WITH AUTOMATIC MODE SETTING

[75] Inventors: Katsushi Furuichi, Yokohama; Toshio Honma, Tokyo; Katsumi Murakami, Kawasaki, all of Japan

[73] Assignee: Canon Kabushiki Kaisha, Tokyo, Japan

[21] Appl. No.: 940,740

[22] Filed: Sep. 8, 1978

[30] Foreign Application Priority Data

Sep. 9, 1977 [JP] Japan ..... 52/108572
Sep. 9, 1977 [JP] Japan ..... 52/108580
Sep. 9, 1977 [JP] Japan ..... 52/108581

[51] Int. Cl.[3] ..... G03G 15/00

[52] U.S. Cl. ..... 355/14 R; 355/35 H; 355/55

[58] Field of Search ..... 355/14, 35 H, 3 DD, 355/10, 55–60, 67–71

[56] References Cited

U.S. PATENT DOCUMENTS

| | | | |
|---|---|---|---|
| 4,027,963 | 6/1977 | Hoppner et al. | 355/8 |
| 4,087,171 | 5/1978 | Yano | 355/10 X |
| 4,095,884 | 6/1978 | Okamoto et al. | 355/71 X |

*Primary Examiner*—R. L. Moses

*Attorney, Agent, or Firm*—Fitzpatrick, Cella, Harper & Scinto

[57] ABSTRACT

An image forming device having a plurality of image forming modes to enable an image reproduced member to be formed under various conditions, in which a predetermined image forming mode is selected out of the abovementioned image forming modes and automatically set when the power source is turned on, or after the image formation has been finished, or in other particular states.

21 Claims, 17 Drawing Figures

IMAGE FORMING DEVICE WITH AUTOMATIC MODE SETTING

BACKGROUND OF THE INVENTION

1. Field of the Invention

This invention relates to an image forming device to form an image on an image bearing member. More particularly, the invention is concerned with an image forming device, in which processing device for the image formation is operated under various conditions (such as sheet size, image density, image magnification, and so forth) so that the image formed on the reproduction member (i.e. the image bearing member, on which an image has been formed, may be varied.

2. Description of the Prior Arts

At present, the image forming device such as reproduction apparatus, etc. is provided with various change-over switches such as image density changing switch, paper size or paper feeding cassette changing switch, image magnification changing switch, and so forth. On the other hand, "state of ordinary use" of such group of change-over switches is generally fixed or set in accordance with their use. In the conventional image forming device, however, when the abovementioned switching devices are once operated from their "state of ordinary use" to another state, it is not possible to reinstate them automatically to their original state. On account of this, it happens from time to time that the image formation is carried out without verifying the state of the switching device and results in an unexpected or undesirable reproduced image before undesirable. Such undesirable reproduction operation constitutes loss in time and money.

Concrete examples of such undesirable reproduction operations will be enumerated in the following.

(1) In the conventional image forming device, e.g., reproduction apparatus, it has been a common practice that an operator of the reproduction apparatus sets an image density designating switch so that a desired image density may be designated for the reproduction. This image density designating switch, however, designates a density of an image which was set at the time of the previous reproduction operation, when the power source for the reproduction apparatus is turned on. Owing to this, if a dark image density was set for the previous reproduction, it happens sometimes that the density designating operation for the current reproduction is forgotten, even when a medium or standard image density is desired, with the consequence that there are obtained reproduction copies having dark image density which wastes the copying material.

(2) In the conventional image forming device having a plurality of discharging sections which receive and hold therein image reproduced members, e.g., the image forming device having one tray and one sorter, any desired discharging section is selected by a push-button operation to change over the image receiving section for use. It is, however, not possible to discriminate, immediately after turning on the power source for the image forming device, whether the discharging section is the tray or the sorter. As the result, a operator is required to push the button to select the desired discharging section. The same operation is necessary, when a previous operator used the sorter as the discharging section for the image reproduced member, and a later operator uses the tray as the discharging section. Such is a very complicated procedure.

(3) In the image forming device having a plurality of paper feeding sections, each of which feeds image transfer paper of different size, quality, color, etc. in the material, it has been a usual practice to select a desired paper feeding section from these plurality of feeding sections by operating the push button for the necessary change-over. For instance, in case one paper feeding section feeds A-4 size image transfer paper, and the other paper feeding section feeds B-4 size image transfer paper, it has heretofore not been possible to know, immediately after the power source for the image forming device has been turned on, whether the paper feeding section as set is for A-4 size paper or B-4 size paper. As a consequence, the operator has to push a selection button to choose a desired paper feeding section. The same operation is necessary when a previous operator used the B-4 size paper feeding section for the image formation, and a later operator uses the A-4 size paper feeding section, which is very troublesome.

(4) In the image a reproduction device such as reproduction apparatus capable of varying image magnification, those operators using the reproduction apparatus carry out, in most cases, the image formation in the same size as that of the image original (hereinafter referred to as "equal image magnification"), and effect few enlargement or size-reduction of the image original (hereinafter referred to as "varying image magnification"). In such conventional image forming device, however, it occurs sometimes that the operator forgets the image magnification designating operation after termination of the image forming in the varying image magnification mode or after turning on the power source for the image forming device with the result that a reproduced image in varied magnification is obtained in place of the intended image reproduction in the equal image magnification, which causes waste in material and time for the operation.

SUMMARY OF THE INVENTION

It is an object of the present invention to provide an image forming device to form reproduced image under various conditions, in which a mode setting device which automatically sets the mode for the image formation under a predetermined condition out of various reproduction conditions, when the device is under a particular state, is used.

It is another object of the present invention to provide an image forming device capable of changing over these various conditions into any desired one, after turning on of the power source to operate the image forming means.

It is still another object of the present invention to provide an image forming device capable of carrying out the image formation with a predetermined image density by the turning on of the power source.

It is other object of the present invention to provide an image forming device capable of automatically changing over the paper feeding section or discharging section, after the image formation has been carried out by use of the discharging section.

It is still other object of the present invention to provide an image magnification changing device capable of automatically reinstating the reproduction device to its original state, wherein the image forming operation in the equal image magnification or the varying image magnification in ordinary use, without necessity for effecting the image magnification designating operation after turning on of the power source for the image forming device, or after the image formation in the varying image magnification mode.

The foregoing objects and other objects of the present invention will become more apparent from the following detailed description of the invention, when read in conjunction with the accompanying drawing.

DESCRIPTION OF THE PREFERRED EMBODIMENTS

Figure 1:
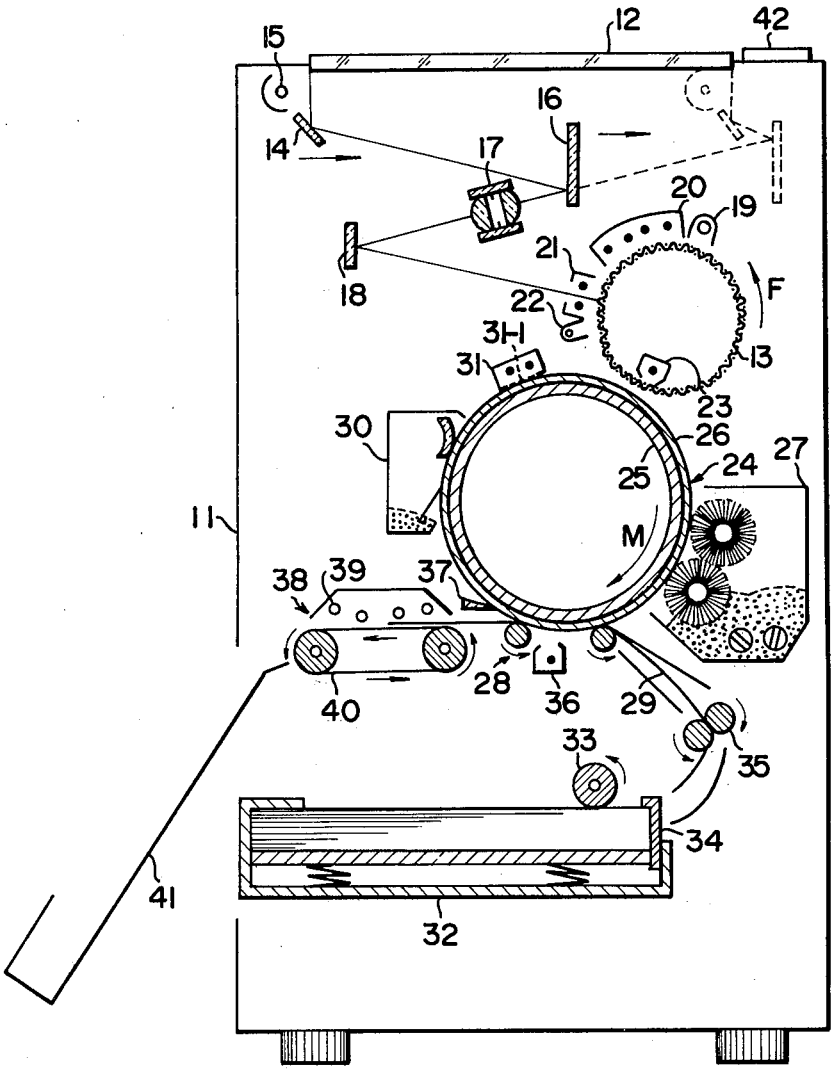
FIG. 1 is a side elevational view in cross-section of one embodiment of the reproduction apparatus according to the present invention.

In the following, the first embodiment of the reproduction apparatus according to the present invention will be described in reference to FIG. 1.

In the drawing, a reference numeral 11 designates a housing to encase the reproduction apparatus. An image original such as a book, periodical, etc. is placed on an image original placing table 12 made of a transparent member such as glass, etc. mounted on the top part of the housing 11. This image original placing table 12 is of a fixed or stationary type, and irradiation of the image to a screen drum 13 to be mentioned hereinafter will be effected by partial shifting or movement of optical devices. The optical means is of a well known type, in which a first mirror 14 and an image original illuminating lamp 15 move from a position shown in a solid line to another position shown in a dash line at the right end of the device at a speed V to cover the whole distance of the abovementioned original image placing table 12. Simultaneously with movement of the first mirror 14 for scanning the image original on the image original placing table 12, a second mirror 16 moves from a position shown in a solid line to another position shown in a dash line at the right end of the device at a speed V/2. The image of the original to be reproduced which has been obtained by scanning operations of the first and second mirrors 14 and 16 is further irradiated onto the screen drum 13 rotating at a peripheral speed V through a lens system 17 having an aperture mechanism and a fixed mirror 18. The screen drum 13 is in a cylindrical network form composed of a photoconductive layer provided on an electrically conductive layer, over which a transparent insulative layer is laid. More detailed disclosure of this screen drum will be found in the U.S. patent application Ser. No. 771,309 filed in 1977 and assigned to the assignee of the present application. The screen drum 13 rotates in the direction of an arrow F. A group of a latent image forming means are disposed in the vicinity of the screen drum along the rotating direction thereof. In more detail, a reference numeral 19 designates a pre-exposure lamp which enables the photoconductive member constituting the screen drum 13 to be used in a constantly stabilized photo-hysteresis state. A numeral 20 refers to a corona discharger which is a primary voltage application means, and charges the screen drum 13 to a sufficient voltage level. A numeral 21 is another corona discharger which is a secondary voltage applying means, and forms a primary electrostatic latent image by irradiation of the image original, while removing electric charge on the screen drum 13 thereby. For this purpose, the corona discharger 21 is in such a construction that a shielding plate at the back surface thereof is optically opened. A reference numeral 22 designates an overall irradiation lamp to uniformly irradiate the screen drum 13 so as to rapidly increase the electrostatic contrast of the primary electrostatic latent image. By the use of these latent image forming means, a primary electrostatic latent image of high electrostatic image contrast is formed on the screen drum 13. The primary electrostatic latent image thus formed on the screen drum 13 is further formed into a secondary electrostatic latent image by a modulating corona discharger 23 on an insulated drum 24 rotating in a direction of an arrow M. The insulated drum 24 is of such a construction that an insulative layer 26 is coated on an electrically conductive supporting member or substrate 25. The secondary electrostatic latent image can be formed on this insulated drum 25 by applying a voltage across the electrically conductive substrate 25 and the electrically conductive member of the screen drum 13, and leading the modulating corona ion to the surface of the insulative layer 26. The secondary electrostatic latent image thus formed on the insulative layer 24 is then developed by a developing device 27 (any well known wet type or dry type developer) to be turned into a toner image. Thereafter, the toner image is transferred onto an image transfer material (in sheet form) 29 which has been conveyed to a designated image transfer position 28 in synchronism with the toner image. The insulated drum 24 which has been subjected to the image transfer process is thereafter cleaned by a cleaner or cleaning device 30 to remove residual toner on the insulative layer 26, and then further rendered by a corona discharger 31 to have a uniform surface potential so as to be ready for the subsequent reproduction process. The image transfer material 29 to be conveyed to the image transfer position 28 is loaded in a paper feeding cassette 32, separated one by one by a forwarding roller 33 and a separating pawl 34, and transported to the corresponding position of the toner image by register rollers 35. A reference numeral 36 is a corona discharger for the image transfer which is to apply a bias voltage to the image transfer material 29 at the time of transfer of the toner image. After the image transfer, the image transfer material 29 is separated from the insulated drum 24 by a separating pawl 37 and forwarded to an image fixing device 38 where the toner image is fixed by a heater 39. After the image fixing, the image transfer material (or image bearing member, on which the image has been formed) is conveyed to a receiving tray 41 for the finished image bearing member by means of a conveyor belt 40.

In the above-described reproduction apparatus, as the secondary electrostatic latent image is formed from the primary electrostatic latent image which is once formed on the screen drum 13, there is no necessity for re-scanning the image original when a plurality of copies are to be made. Accordingly, for the purpose of making a plurality of copies, it is only sufficient that the process steps subsequent to the secondary electrostatic latent image formation be effected. This results in increase in the rotational speed of the screen drum 13, and quickening the reproduction speed.

Figure 2:
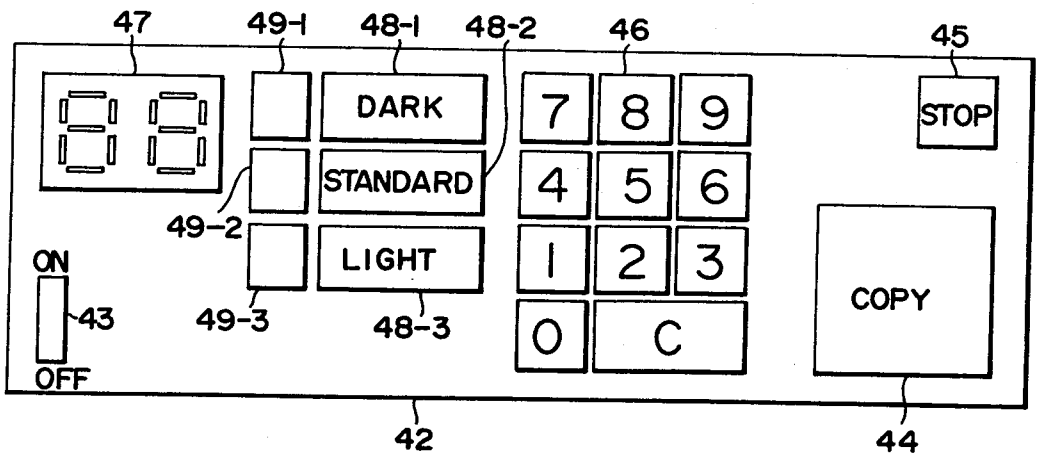
FIG. 2 is a top plan view showing an operating panel in the reproduction apparatus shown in FIG. 1.

FIG. 2 shows a top plan view of an operating panel which is designated by a reference numeral 42 in FIG. 1. The operating panel 42 contains therein a power source switch 43 to control supply of electric power to the reproduction apparatus, a copy start instruction switch 44 to instruct commencement of the copying operation, a copy stop instruction switch 45 to instruct stoppage of the copying operation, a copy number switch 46 to set the number of copies to be obtained, a display device 47 to indicate the number of copy sheet as set by the copy number switch 46, an image density swith 48 to input the density of the image original to be reproduced (the image density selection switch 48 consists of a switch 48-1 to instruct that the image original is dark, a switch 48-2 to instruct that the image original is of standard density, and a switch 48-3 to instruct that the image original is light), and a display device 49 to show the density as selected by the image density switch 48 (the display device 49 correspondingly consists of display device 49-1, 49-2 and 49-3).

While the image density switch 48 is to designate density of the image original to be reproduced, it is also to designate that, when the informations in the image original are dark in density, they will be recorded on the image transfer paper in a lighter density than the standard density, and, when the informations in the image original are light in density, they will be recorded on the image transfer paper in a density darker than the standard density. In other words, the density switch 48 is to instruct the density of the recorded image on the image transfer paper. That is, when the switch 48-1 is depressed, the image reproduced on the image transfer material is lighter in density than the standard density, and, when the switch 48-3 is depressed, the image reproduced on the image transfer material is darker in density than the standard density.

In the above-described reproduction device, the electric charge to be uniformly formed on the insulated drum 24 is determined by a voltage to be applied to a grid electrode 31-1 of the corona discharger 31. Therefore, the adhering quantity of the toner to the secondary electrostatic latent image can be controlled by controlling the voltage to be applied to the grid electrode 31-1, whereby the image density to be transferred to the transfer material can be controlled.

Figure 3:
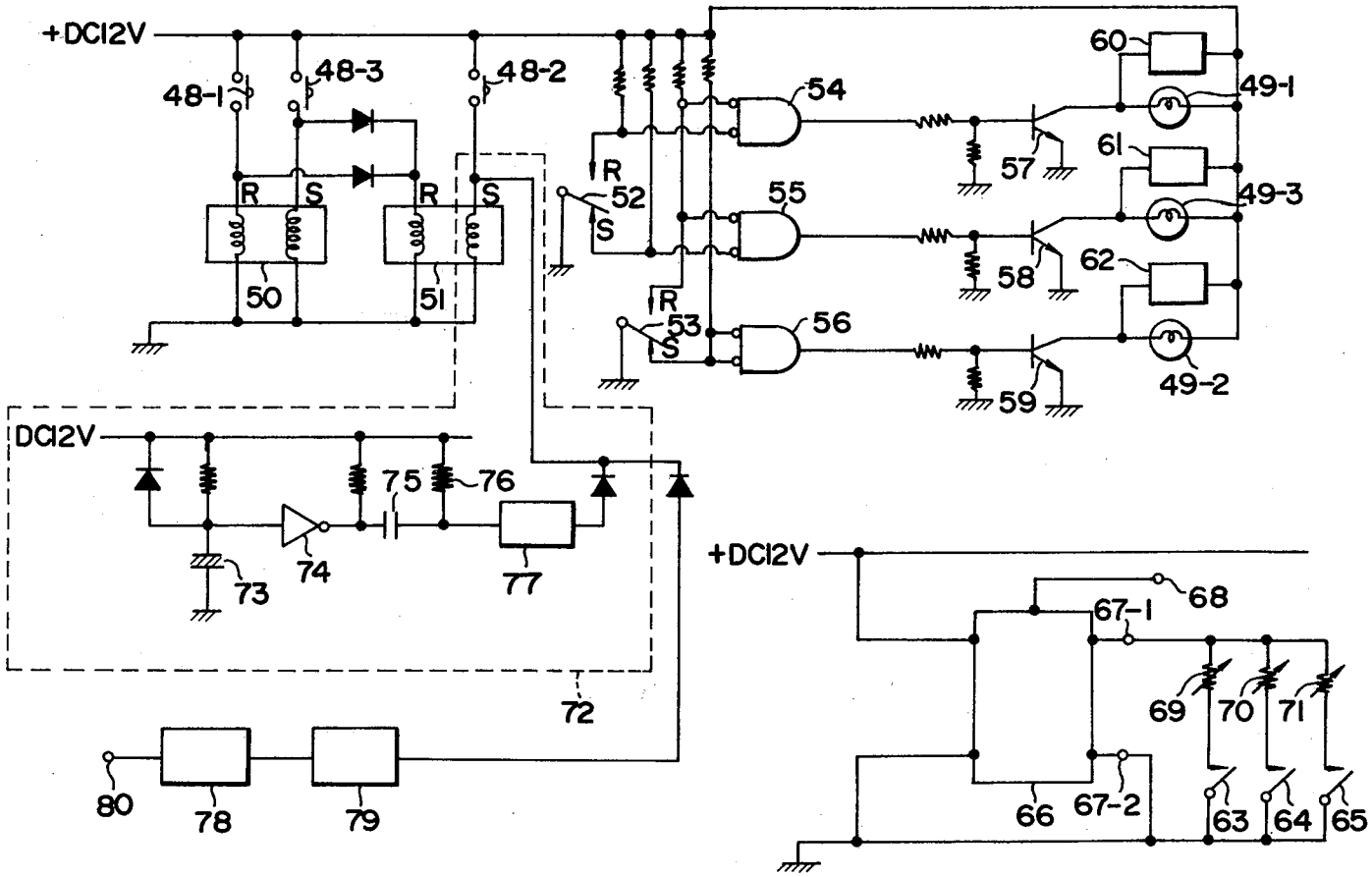
FIG. 3 is a diagram showing an image density setting circuit including an instruction circuit.

The image density switch 48 is also to select the grid voltage for the corona discharger, and is constructed as a part of the density setting circuit as shown in FIG. 3. In more detail, the density switch 48-1 to 48-3 are respectively connected with relays 50, 51 having switches 52, 53. When the switch 48-1 is turned on, reset terminals R of the switches 52, 53 are grounded. Also, when the switch 48-2 is turned on, a set terminal S of the switch 53 is grounded. Further, when the switch 48-3 is turned on, a set terminal S of the switch 52 is grounded, and the reset terminal R of the switch 53 is grounded.

Accordingly, when the switch 48-1 is depressed, an output is lead out of an AND gate 54 to turn a transistor 57 on. When the switch 48-2 is depressed, an output is led out of an AND gate 56 to turn a transistor 59 on. When the switch 48-3 is depressed, an output is led out of an AND gate 55 to turn a transistor 58 on.

When the transistor 57 is turned on, the display device 49-1 is lit, and a relay 60 is actuated to turn a relay switch 63 on. When the transistor 58 is turned on, the display device 49-3 is lit and a relay 61 is actuated to turn a relay switch 64 on. When the transistor 59 is turned on, the display device 49-2 is lit and a relay 62 is actuated to turn a relay switch 65 on.

A reference numeral 66 designates a high voltage generator which leads out to a terminal 68 a high voltage corresponding to a voltage applied across a terminal 67-1 and a terminal 67-2. Accordingly, by connecting resistors 69 to 71 in series with the abovementioned switches 63 to 65, respectively, and by selecting a resistance value in these resistors, it becomes possible to construct the density setting circuit in such a manner that, when the switch 63 is turned on, a low voltage (e.g. 100 V) is led out at the terminal 68; when the switch 65 is turned on, a standard voltage (e.g. 150 V) is led out at the terminal 68; and when the switch 64 is turned on, a voltage higher than the standard voltage (e.g. 200 V) is led out at the terminal 68.

Therefore, if the terminal 68 is connected with the grid electrode 31-1 of the abovementioned corona discharger, recorded image density can be designated by selection of the switch 48.

In FIG. 3, a reference numeral 72 designates an instruction circuit to instruct a standard image density when the power source is turned on by closure of the power source switch 43 of the recording apparatus. By turning on of the power source, this instruction circuit 72 applies a signal to the terminal S of the relay 51 to connect the switch 53 with the set terminal S, thereby instructing the standard image density.

Figure 4:
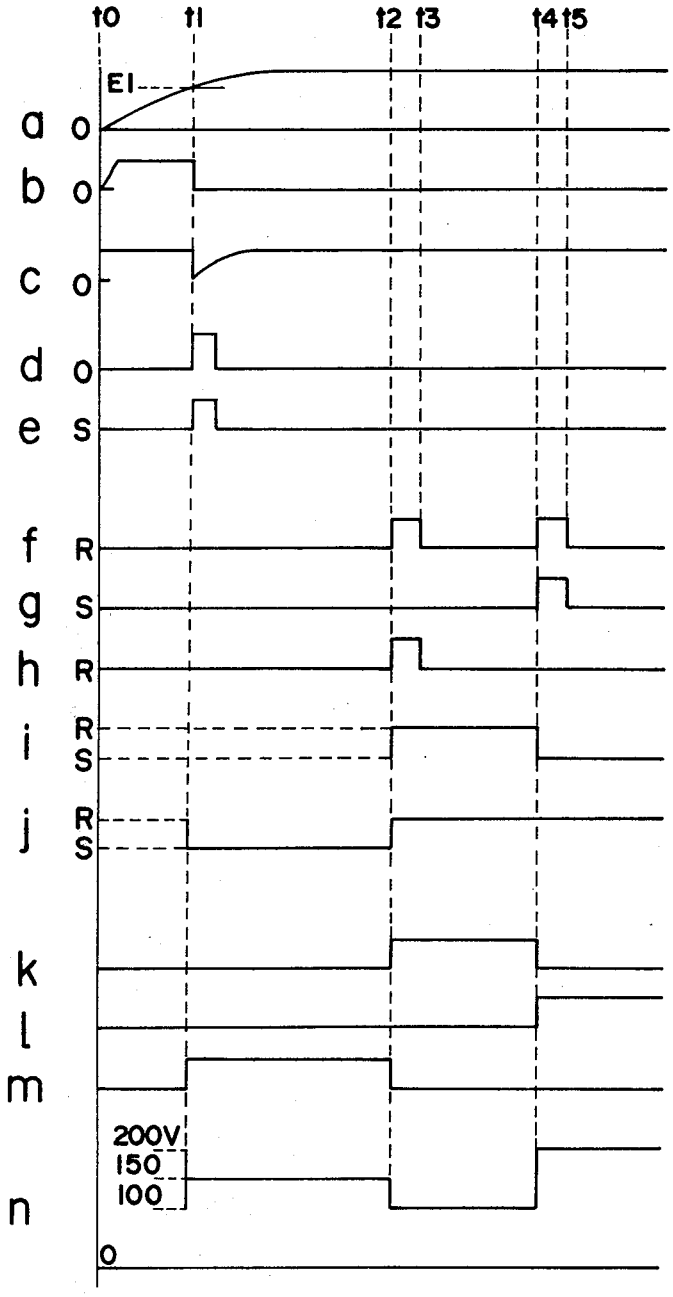
FIGS. 4(A) through (N) respectively show signal waveforms at every part of the circuit shown in FIG. 3.

The operation of this instruction circuit 72 will be further explained in detail in reference to FIG. 4, as follows.

At a time instant $t_0$, the power source switch 43 is turned on, when a voltage in a capacitor 73 gradually rises as shown in FIG. 4(A). While the terminal voltage in this capacitor 73 is applied to an inverter 74, as this inverter 74 has a threshold voltage E1, it produces an output only during a period (time instants of from $t_0$ to $t_1$) until the terminal voltage of the capacitor 73 reaches the threshold voltage E1 as shown in FIG. 4(B).

The output from the inverter 74 is differentiated by a differentiation circuit constructed with a capacitor 75 and a resistor 76, and represented by an output waveform as shown in FIG. 4(C). This output waveform is further applied to a one-shot/multi 77 to form a pulse waveform as shown in FIG. 4(D). Since this pulse signal is applied to the set terminal S of the relay 51 as shown in FIG. 4(E), the switch 53 is connected with the set terminal S as shown in FIG. 4(J), whereby the relay 62 is driven as shown in FIG. 4(M), and the switch 65 is turned on. Accordingly, a voltage of 150 V is applied from the high voltage generator 66 to the grid electrode 31-1 of the corona discharger 31, thereby instructing the standard image density. When the image original is in the standard image density, the copying operation can be standard as it is.

At a time instant $t_2$, when an operator turns on the switch 48-1 for a period of $t_2$–$t_3$, signals as shown in FIGS. 4(H) and 4(F) flow into the reset terminal R of the relay 50 and the reset terminal R of the relay 51, respectively, to control the switches 52 and 53 as shown in FIGS. 4(I) and 4(J), whereby the relay 60 is driven as shown in FIG. 4(K) to turn the switch 63 on, and a voltage of 100 V is applied to the grid electrode 31-1 of the corona charger 31 as shown in FIG. 4(N).

Also, when the operator pushes the switch 48-3 during a period of $t_4$–$t_5$, driving signals as shown in FIGS. 4(F) and 4(G) flow into the reset terminal R of the relay 51 and the set terminal S of the relay 50 to control the switches 52 and 53 as shown in FIGS. 4(I) and 4(J), whereby the relay 61 is driven as shown in FIG. 4(E) to turn the switch 64 on, and a voltage of 200 V is applied to the corona charger 31 as shown in FIG. 4(N). It is possible to construct the circuit in such a manner that a copy terminating signal applied to a terminal 80 may be applied to the relay 51 after it is shaped by a waveform shaping circuit 78 and subsequent to application of the same to a delay circuit 79 with a delay time $\tau$. With such circuit construction, after lapse of the time $\tau$ since termination of the copying operation, it is possible to change-over to the standard image density.

In the above-described embodiment, explanations have been given as to the reproduction apparatus, in which the secondary electrostatic latent image is repeatedly formed from the primary electrostatic latent image. It should, however, be noted that the present invention is not limited to such reproduction apparatus alone, but it can be applied to ordinary electrophotographic reproduction apparatus, in which an electrostatic latent image is formed by light from the image original on a photosensitive drum, then the electrostatic latent image on the photosensitive drum is developed with toner, and the thus developed image is transferred onto an image transfer paper, diazo type reproduction apparatus, and various other types of reproduction apparatus. Also, the density adjusting means is not limited to adjustment of abovementioned corona charger, but any other types of expedient such as adjustment of other corona chargers, adjustment of a development bias, adjustment of an image original exposure lamp, and so on.

As stated in the foregoing, the reproduction apparatus according to the present invention instructs a predetermined density for image reproduction at the time of turning on of the power source, and can also instruct that the image density is brought to a predetermined density after lapse of time $\tau$ upon completion of the copying operation, so that the reproduction operation becomes extremely easy.

In the following, the second embodiment of the reproduction apparatus according to the present invention will be explained in reference to FIG. 5. The drawing shows a schematic cross-section of the electrophotographic reproduction apparatus, to which the present invention is applicable, in which a reference numeral 101 designates a photosensitive drum in a network or screen form having a transparent insulative layer, a photoconductive layer, and an electrically conductive layer in lamination in the order as mentioned from the outer surface thereof, 102 refers to a primary charger, 103 a secondary charger, 104 a lamp, 105 an image original placing table, 106 a modulating charger, 107 an insulated drum, 108 a developer, 109A rollers to feed A-4 size image transfer paper 110A, 109B rollers to feed B-4 size image transfer paper 110B, 111 an image transfer charger 112 a conveyor belt, 113 an image fixing roller, 114 a tray, 118 a sorter, 120 ten units of paper storing bins, 152A a cassette to feed image transfer paper 110A, and 152B a cassette to feed image transfer paper 110B.

A primary electrostatic latent image is formed by subjecting an image original on the image original placing table 105 to slit-exposure by the lamp 104, while a mirror 115 is being moved, and irradiating the exposed image onto the rotating photosensitive drum 101 which has been previously charged by the primary charger 102 simultaneously with the secondary charge by the secondary charger 103. This primary electrostatic latent image is then modulated by the modulating charger 106 to form the secondary electrostatic latent image on the surface of the insulated drum 107. This secondary electrostatic latent image is developed by the developer 108. The developed image is transferred by means of the charger 111 onto image transfer paper 110A or 110B fed from the paper feeding cassette 152A or 152B. The image transfer paper 110A or 110B thus image-transferred is conveyed to the heat-roller type image fixing device 113 to fix the toner image on the paper, and is finally discharged into the sorter 118 or the tray 114.

Since the primary electrostatic latent image is not extinguished even after formation of the secondary electrostatic latent image, it is possible to continuously form the secondary electrostatic latent image by the charger 106 on the photosensitive drum 101 by further rotation thereof, to forward the image transfer paper 110 one by one to the image transfer position for image transfer of the secondary latent image thereon, followed by the image fixing and discharge of the image-fixed transfer paper into the tray. Incidentally, a reference numeral 116 designates a lamp to remove the surface electric charge on the photosensitive drum 101, and a numeral 117 refers to a cleaning section to remove the toner on the surface of the insulated drum 117.

Figure 5:
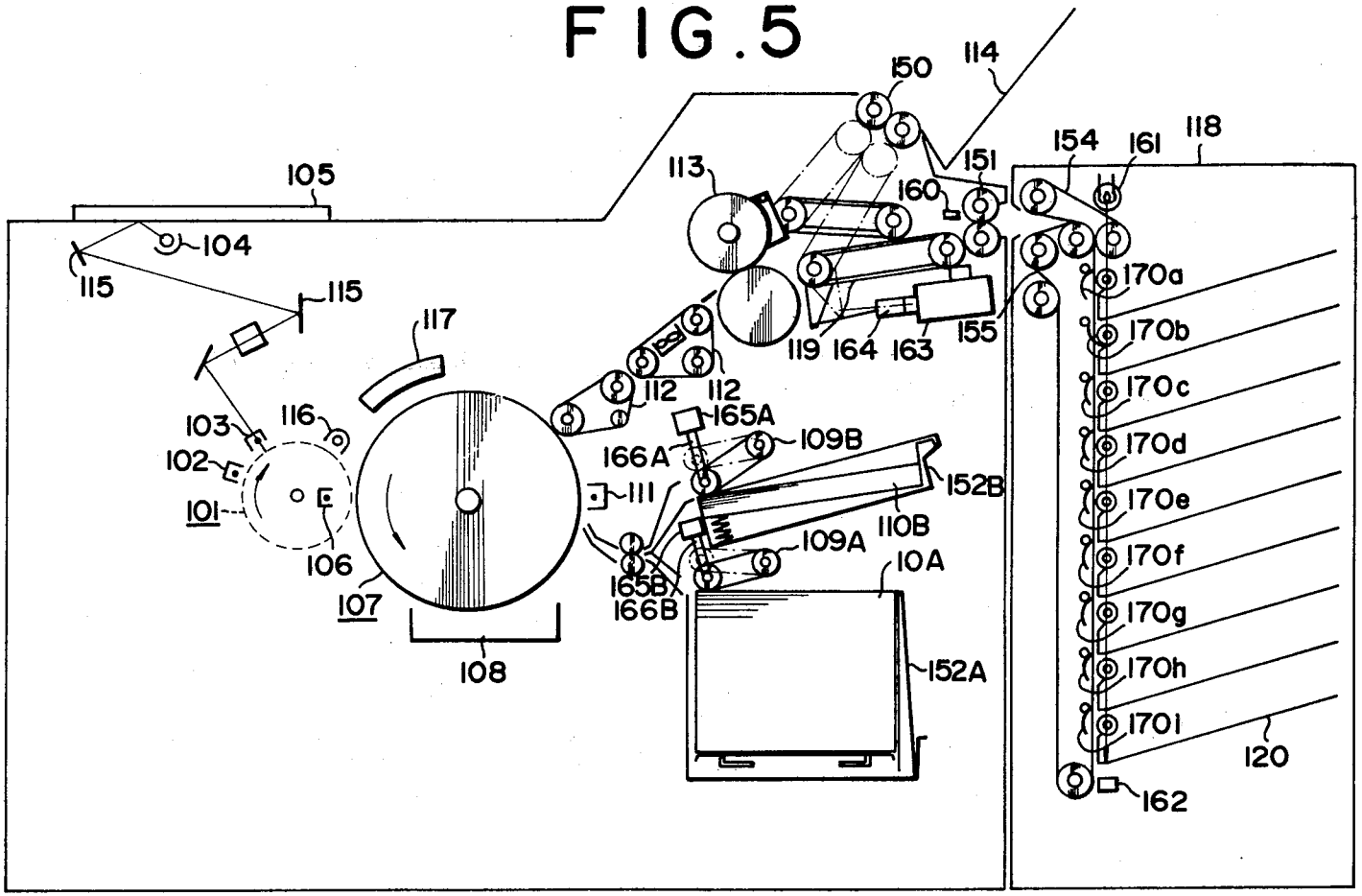
FIG. 5 is a side elevational view in cross-section of another embodiment of the reproduction apparatus according to the present invention.
Figure 6:
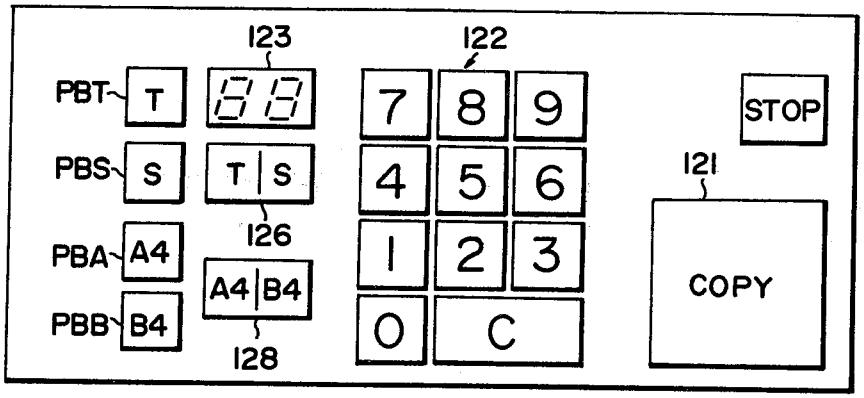
FIG. 6 is a top plan view of an operating and displaying panel in the reproduction apparatus shown in FIG. 5.

FIG. 6 is the top plan view of the operating panel on the reproduction apparatus in FIG. 5. In the drawing, a reference numeral 121 designates a copy start button, 122 a copy number setting key, 123 an indicator for the set number of copy, PBT a tray selection key, PBS a sorter selection key, 126 an indicator which displays whether the discharge section is the sorter or the tray, PBA an A-4 size cassette selection key, PPB a B-4 size cassette selection key, and 128 an indicator for the cassette size selection keys.

When the tray 114 is selected as the discharging section, a conveyor belt 119 in FIG. 5 is set at a position shown by a dot line, and an image transfer paper 110A or 110B is discharged through first discharge rollers 150 and received in the tray 114. When the sorter 118 is selected as the discharging section, the conveyor belt 119 is set at a position shown by a solid line, and the image transfer paper 110A or 110B is discharged through second discharge rollers 151 and received in the sorter 118. Also, when the A-4 size image transfer paper 110A is selected, the principal paper feeding cassette 152A is designated and fed, if the A-4 size image transfer paper is stored therein. 152B designates the auxiliary paper feeding cassette which is used when no paper is stored in the principal paper feeding cassette 152A. In this case, if the image transfer paper of the same size as that in the cassette 152A is present therein, driving of the paper feeding rollers 109 is automatically changed over, and the paper is fed from the auxiliary paper feeding cassette 152B. Incidentally, the principal paper feeding cassette 152A is able to store therein the image transfer paper of from 2,000 to 3,000 sheets, while the auxiliary paper feeding cassette 152B can accommodate therein 500 to 1,000 sheets of the image transfer paper. The paper forwarded to the sorter 118 is carried by a belt 155 which is constantly moving, and further forwarded to any of the storing bins. Guiding pawls 170*a* through 170*i* are provided at every storing bins. The guiding pawls are sequentially operated at every time a detector 160 detects the paper to be stored in each bin.

Figure 7:
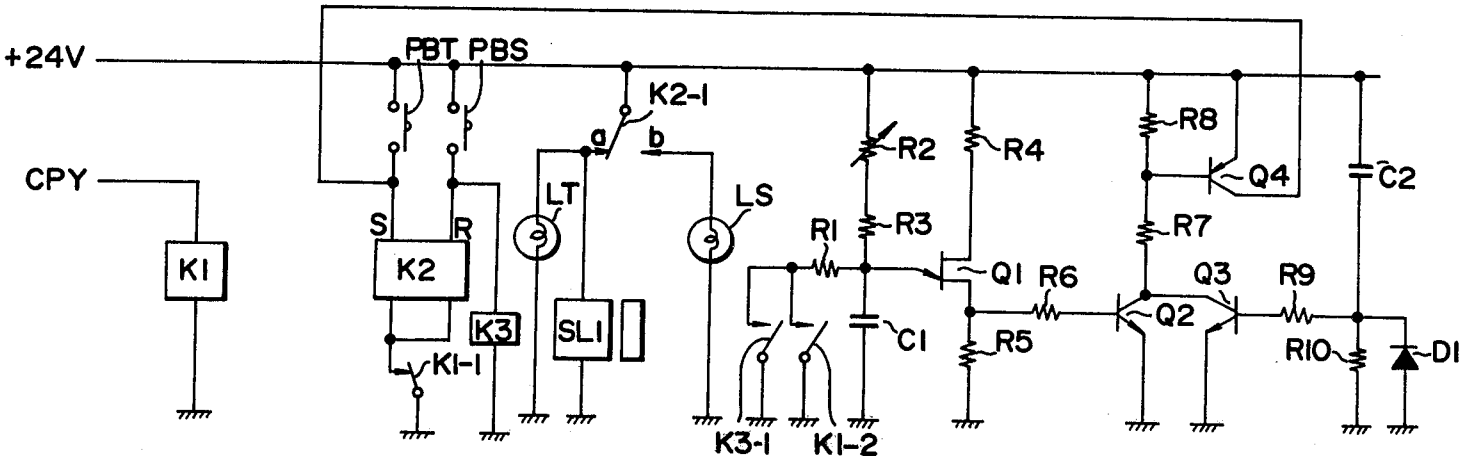
FIG. 7 is a diagram showing a control circuit for changing over discharge sections.
Figure 8:
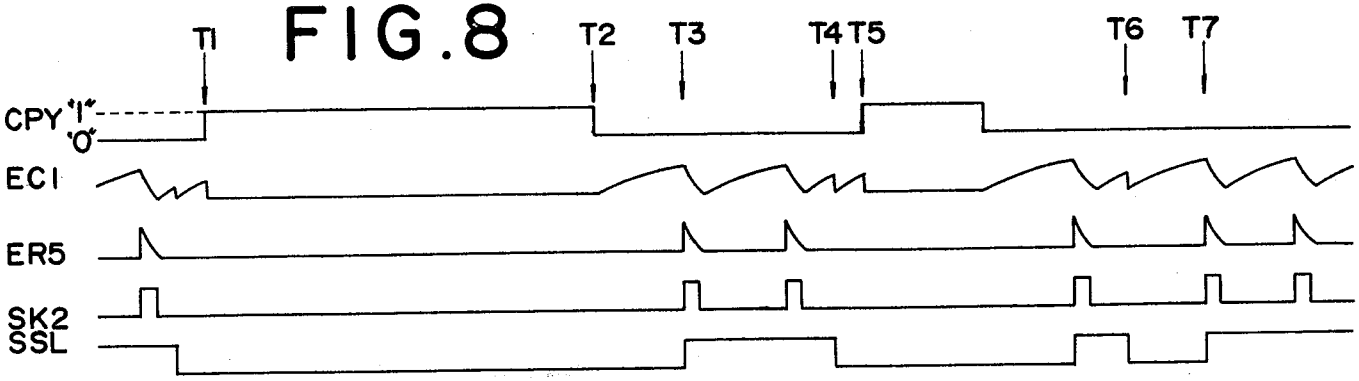
FIG. 8 shows various signal waveforms in every part of the circuit shown in FIG. 7.

In the following, a detailed explanation will be given as to change-over control of the tray and the sorter as the discharging section. FIGS. 7 and 8 respectively show the change-over control circuit between the tray and the sorter and the timing chart at every part of the control circuit. In the drawing, SL1 designates a solenoid for changing over the tray and the sorter, K1, K2 and K3 relays, LT a display lamp indicating use of the tray, LS a display lamp to indicate use of the sorter, Q1 a uni-junction transistor (hereinafter abbreviated as "UJT"), CPY a copy signal, EC1 a terminal voltage of a capacitor C1, ER5 a terminal voltage of a resistor R5, SK2 an input signal to a winding S of a latching relay K2, and SSL an input signal to the solenoid SL1. When the tray selection key PBT is depressed, a voltage is applied to the winding S of the latching relay K2, and a contact point K2-1 is connected to the side a. Since the relay K2 is the latching relay, it maintains the original state even when it no longer energized. When the contact point K2-1 is connected to the side a, the lamp LT to indicate use of the tray (or exit position indicating lamp) is turned on to notify the operator to this effect through display device 126 in FIG. 6. At the same time, electric current flows in the solenoid SL1 to actuate the same. An electromagnetic plunger 163 pulls a lever 164, whereby a pair of upper and lower conveyor belts 119 move to a position shown by dotted lines, i.e., to the paper discharging exit at the tray side. When the sorter selection key PBS is depressed, a voltage is applied to a winding R of the relay K2, whereby the contact point K2-1 is connected to the side b and the display lamp LS to indicate use of the sorter, i.e., the exit position indicating lamp is turned on and notifies the operator to this effect. At the same time, since the solenoid SL1 is deenergized, the plunger 163 is also released, whereby the lever 164 extends again to cause the conveyor belt 119 to move to a position shown in solid line, or, the paper discharging exit at the side of the sorter.

In the following, explanations will be given as to the operation of the control circuit when the sorter 118 is selected as the discharging section. When the copy button 121 is depressed at a time instant $T_1$ in FIG. 8 and the copy signal CPR assumes a level "1", the relay K1 is turned on, and the contact point K1-1 which is constantly closed is opened. As a result, the relay K2 is not actuated even when the tray selection key PBT is depressed, thereby creating a change-over prohibiting condition. At the same time, the contact K1-2 is closed to stop charging of the capacitor C1. When the copying operation terminates at a time instant $T_2$, the copy signal CPY assumes a level "0" and the relay K1 is turned off. As a result, the abovementioned contact K1-1 is closed to release the change-over prohibiting condition, and the change-over operation becomes possible. At the same time, the contact point K1-2 is opened and the charging of the capacitor C1 commences through resistors R2 and R3. The charging circuit constructed with the resistors R2 and R3 as well as the capacitor C1 is connected with the emitter of UJT Q1. At a time instant $T_3$, i.e., when a terminal voltage EC1 of the capacitor C1 becomes $24\times\eta$[V], where $\eta$ is an open voltage ratio of UJT Q1, resistance between the base and the emitter of UJT Q1 becomes low with the consequence that electric charge in the capacitor C1 is discharged through the resistor R5 and a voltage is generated in the resistor R5. This is the well known oscillating circuit, the oscillation frequency of which can be adjusted by the variable resistor R2. In this embodiment, it is selected in a range of from 30 to 60 seconds or so. The oscillation output of this oscillating circuit constitutes the voltage ER5 which is imparted to the resistor R5, the output of which is amplified by the transistors Q2 and Q4 and introduced into the winding S of the relay K2 as an input thereto. In more detail, the winding S of the relay K2 is energized at the time instant $T_3$ after lapse of 30 to 60 seconds from the time instant $T_2$ when the copying operation terminates to thereby change over the contact point K2-1 to the side a. In this consequence, the solenoid SL1 is excited to actuate the electromagnetic plunger 163, and the conveyor belt 110 moves to the dotted line position to the side of the tray 114. However, when the sorter selection key PBS is depressed between the time instants $T_2$ and $T_3$, the relay K3 is turned on, and a contact point K3-1 is closed, only when the sorter selection key PBS is depressed to discharge the capacitor C1. Therefore, the conveyor belt 119 remains at the solid line position, and, when the copy button 121 is depressed at a time instant $T_5$, the copy paper is discharged to the side of the sorter 118.

After the conveyor belt 119 is moved to the side of the tray 114, when the sorter selection key PBS is depressed at a time instant $T_6$ and no copy button 121 is depressed during the interval of 30 to 60 seconds thereafter, the oscillating circuit oscillates again at a time instant $T_7$, the oscillation output of which is amplified by transistors Q2 and Q3 to excite the winding S of the relay K2. As a result, the contact K2-1 is connected to the side a to energize the solenoid SL1 and to actuate the electromagnetic plunger 163, whereby the conveyor belt 119 is set at the side of the tray 114.

In the following, the operations of the control circuit right after turning on of the power source switch will be explained. Right after the switch is turned on, it is not known whether the contact point K2-1 of the relay K2 is at the side a or at the side b. Therefore, the contact K2-1 is set at the side a by the use of a time constant circuit consisting of resistors R9 and R10 and a capacitor C2, and operating a transistor Q3 right after turning on of the power source switch to apply a pulse having a certain pulse width to the winding S of the relay K2. Since the electric charge of the capacitor C2 right after turning on of the power source switch is zero, it is charged through the resistors R9 and R10. The transistor Q3 operates during a period until the capacitor is completely charged. Also, a transistor Q4 operates through a resistor R7. The collector current of the transistor Q4 flows into the winding S of the relay K2, whereby the contact K2-1 is connected with the side a, the solenoid SL1 is energized to actuate the electromagnetic plunger 163, and the conveyor belt is set to the side of the tray. It is also possible that the conveyor belt be set after lapse of a certain definite time from turning on of the power source.

In this embodiment, the paper discharging exit is provided in each of the discharging sections. It is also feasible that a single paper discharging exit is fixedly provided, and the discharging sections are moved to meet this exit depending on necessity. Further, in this embodiment, the operating mode as changed over is set at the side of the relay, but it is up to the operator's discretion at which side the operating mode is to be set.

Figure 9:
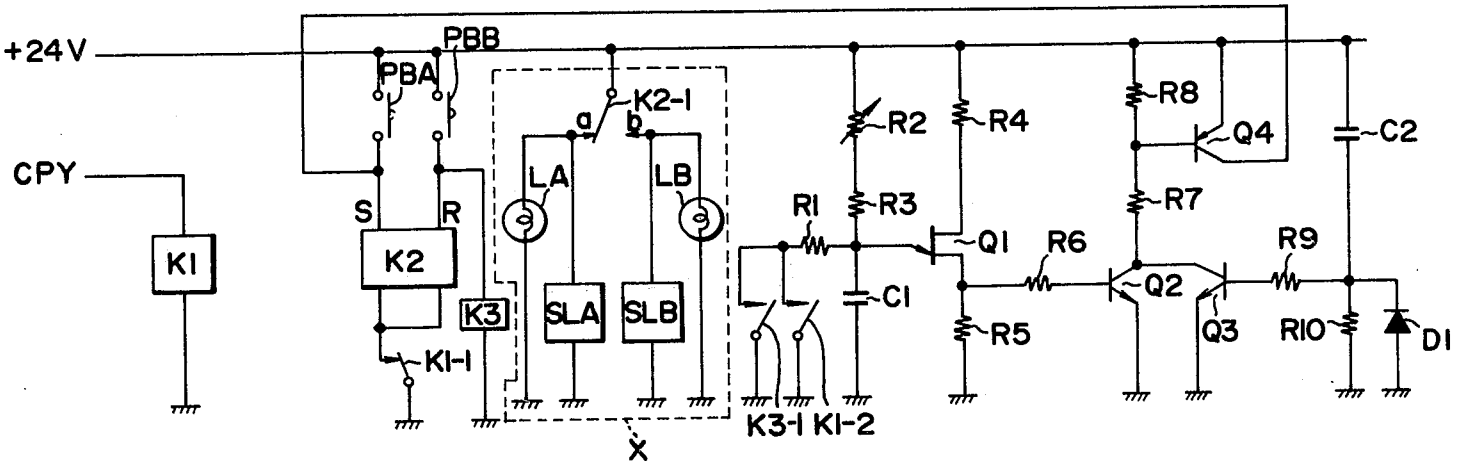
FIG. 9 is a diagram showing a control circuit for changing over paper feeding sections.
Figure 10:
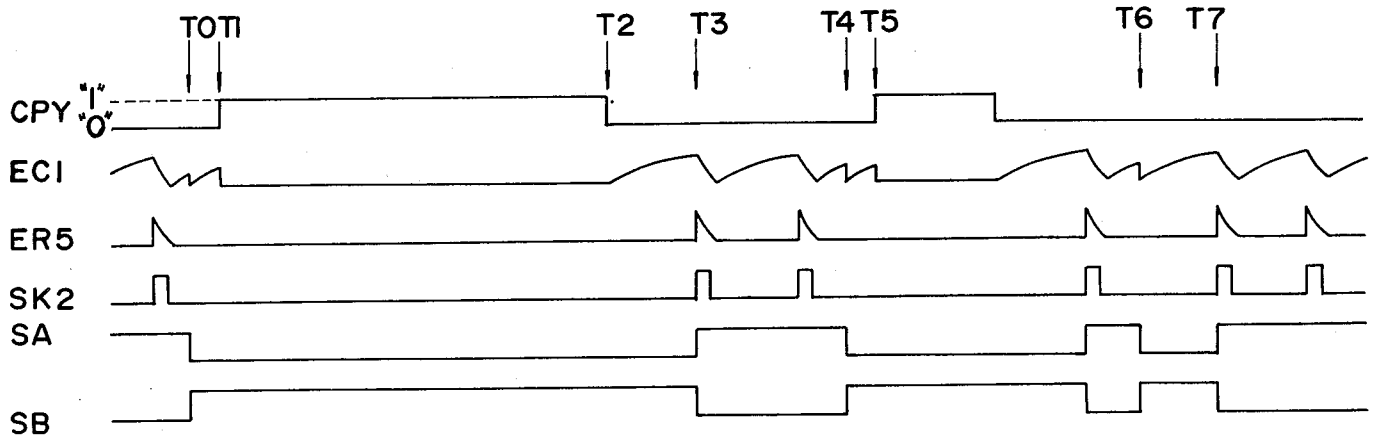
FIG. 10 shows various signal waveforms in every part of the circuit shown in FIG. 9.

In the following, the change-over operations of the paper feeding cassettes will be explained in detail in reference to the drawing. FIG. 9 shows a control circuit for changing over the paper feeding cassette, the drawing being different from FIG. 7 in the portion x enclosed by a dash line, and in that the selection keys PBT and PBS are respectively replaced by the keys PBA and PBB. Therefore, those parts having the same functions as those in FIG. 7 are designated by the same reference numerals and symbols. FIG. 10 shows various signal waveforms at every part of the circuit. In the drawing, PBA refers to a B-4 size cassette instruction button key, 121 a copy button, LA an indicating lamp showing use of A-4 size cassette, LB an indicating lamp showing use of the B-4 size cassette, K1 a relay to hold a copy signal CPY, K2 a latching relay. By the relays K1 and K2, an A-4 size cassette instruction solenoid SLA or a B-4 size cassette instruction solenoid SLB is selected. EC1 refers to a terminal voltage of the capacitor C1, ER5 a terminal voltage of the resistor R5, SK2 a pulse signal to the winding S of the relay K2, SA a pulse input signal to the solenoid SLA, and SB a pulse input signal to the solenoid SLB.

When the switch PBA is depressed, a voltage is applied to the winding S of the latching relay K2, and the contact K2-1 is connected to the side a. (Since the relay K2 is the latching relay, it maintains its original condition, even when it is released from being energized.) This state is notified to the operator by the turning on of the lamp LA. At the same time, the solenoid SLA is turned on to actuate the plunger 165A shown in FIG. 5, whereby the lever 166A is pulled to separate the rollers 109B from the B-4 size image transfer paper 110B to move to the dotted line position. On the other hand, since the plunger 165B is released, and the rollers 109A arrive at the solid line position, preparation for paper feeding of the A-4 size image transfer paper 110A from the cassette 152A is completed. Upon depression of the copy button 121, the rollers 109A rotate to feed the A-4 size paper 110A. It should be noted here that the rollers 109A and 109B may both rotate together, or the rollers 109A alone may rotate.

When the B-4 size selection key PBB is depressed, the contact K2-1 is connected to the side b and the B-4 size display lamp LB is turned on. Simultaneously, the solenoid SLB is turned on to actuate the plunger 165B, whereby the lever 166B is pulled and the rollers 109A are separated from the A-4 size image transfer paper 110A to move to the dotted line position. On the other hand, since the plunger 165A is released and the rollers 109B arrive at the solid line position, preparation for the paper feeding of the B-4 size paper 110B from the cassette 152B is completed. Upon depression of the copy button 121, the paper 110B is fed.

In the following, explanation will be given as to the operation of the control circuit when the copy button 121 is depressed subsequent to depression of the B-4 size selection key PBB. When the switch PBB is depressed at a time instant $T_0$ in FIG. 10 and the copy button 121 at a time instant $T_1$, the reproduction operation starts in the size reduction mode, and the copy signal CPY assumes the level "1", and the relay K1 is turned on to open its contact K1-1, whereby a change-over prohibiting condition, in which the relay K2 does not operate even when the key PBA is depressed, is created. Since the other contact K1-2 of the relay K1 is closed, the capacitor C1 is not charged. When the reproduction operation finishes at the time instant $T_2$, the copy signal assumes a level "0", the relay K1 is turned off, and the contact K1-1 is closed to release the abovementioned change-over prohibiting condition, whereby the change-over operation becomes possible. At the same time, the contact K1-2 is opened, and the electric charging to the capacitor C1 commences through the resistors R2 and R3. The charging circuit is connected to the emitter of the UJT Q1. At a time instant $T_3$, i.e., when a voltage of the capacitor C1 becomes $24\times\eta$[V], where $\eta$ is an open voltage ratio of the UJT Q1, resistance between the base and the emitter of the UJT Q1 becomes low, whereby electric charge in the capacitor C1 is discharged through the resistor R5 and a voltage is generated in the resistor R5. This is the well known oscillation circuit, the oscillation period of which can be adjusted by the variable resistor R2. In this embodiment, it is selected in a range of 30 to 60 seconds or so. The oscillation output of this oscillation circuit constitutes a voltage to be imparted to the resistor R5, the output of which is amplified and introduced into the winding S of the relay K2 as an input thereto. In more detail, the winding S of the relay K2 is excited at a time instant $T_3$ after lapse of 30 to 60 seconds from the time instant $T_2$ when the reproduction operation finishes to change over the contact K2-1 to the side a to render the mode of reproduction to be the A-4 size copy mode (hereinafter called "A-4 mode"). However, when the copy button 121 is again depressed during the time instants $T_2$ and $T_3$, the reproduction operation is conducted in the B-4 size copy mode (or B-4 mode). Also, after the reproduction operation is changed over to the A-4 mode, when the key PBB is depressed at a time instant $T_4$, the relay K3 is turned on, and the contact K3-1 is closed only when the key PBB is depressed. Accordingly, when the capacitor C1 is discharged and the copy button 121 is depressed at a time instant $T_5$ with the reproduction mode being in the B-4 mode, the B-4 size copy can be obtained.

Next, after the reproduction mode is changed over to the A-4 mode, if the key PBB is depressed at a time instant $T_6$ and no copy button 121 is depressed during the time interval of 30 to 60 seconds, the oscillation circuit oscillates again at a time instant $T_7$ and the winding S of the relay K2 is excited through the transistors Q2 and Q4, and the contact K2-1 is connected with the side a for the A-4 mode.

In the following, operation of the circuit right after turning on of the power source switch will be explained. Right after turning on of the power source, it is not known whether the contact K2-1 of the relay K2 is at the side a or at the side b. Therefore, the transistor Q3 is operated immediately after turning on of the power source by the use of a time constant circuit composed of the resistors R9 and R10 and the capacitor C2, thereby applying a pulse having a certain pulse width to the winding S of the relay K2 for the A-4 mode. Since the electric charge of the capacitor C2 immediately after turning on of the power source is zero, it is charged through the resistors R9 and R10. The transistor Q3 operates until the charging operation completes, and the transistor Q4 operates through the resistor R7. The collector current of the transistor Q4 flows into the winding S of the relay K2, whereby the contact K2-1 is connected to the side a and the solenoid SL4 is turned on into the A-4 mode.

In this embodiment, the change-over operation is so effected that A-4 mode is always set, although it is the operator's discretion which mode is to be set. Also, in this embodiment, explanations have been made as to the change-over operation of the paper size alone. It is to be noted that changing over of the cassettes containing therein different quality of the paper, or different color of the paper, and so on is possible. Further, in this embodiment, the cassette selection is done by actuating the plunger by the solenoid to separate the rollers from the image transfer paper. It is also possible to select the cassette by controlling the driving section of the roller without separating the roller from the paper. Furthermore, explanations have been made separately for the change-over operation of the discharging section and the change-over operation of the paper feeding section. It is also possible that both discharging section and paper feeding section can be simultaneously changed over to a mode which is in ordinary use, or any one of them can be changed over with one control circuit being operated.

As stated in the foregoing, in the image forming device such as the reproduction apparatus, when an operator does not instruct the image formation within a certain definite time period after the image formation has been conducted using a discharging section which is not in ordinary use, or after the discharging section which is not in ordinary use has been selected, it is possible to automatically change over to the receiving section in ordinary use without necessity for operating to instruct such receiving section after turning on of the power source.

Or, when the operator does not instruct the image formation within a certain definite time period after formation of the image by the use of the paper feeding section which is not in ordinary use, or after selection of the paper feeding section which is not in ordinary use, it is possible to automatically change over to the paper feeding section in ordinary use without necessity for operating to instruct such paper feeding section after turning on of the power source.

Furthermore, it is possible to automatically change over to the discharging section and the paper feeding section, both in ordinary use, at the same time.

In the following, the third embodiment of the present invention will be explained in detail. This embodiment is for the reproduction apparatus, in which image formation is possible with differing image magnification.

Figure 11:
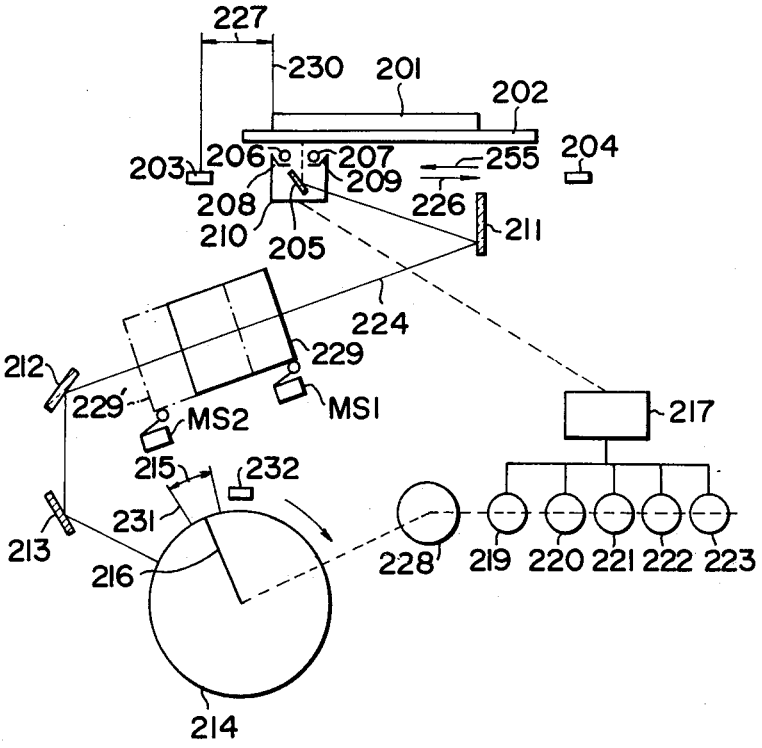
FIG. 11 is a schematic cross-sectional view of still another embodiment of the reproduction device according to the present invention.

Referring to FIG. 11, a reference numeral 201 designates an image original, 202 a transparent image original placing table, 206 and 207 light sources to illuminate the image original 201, 208 and 209 reflecting mirrors to irradiate lights from the light sources 206 and 207 onto the image original 201 with good efficiency, 214 a drum having on its peripheral surface a photosensitive member, 215 a nonphotosensitive portion on the photosensitive drum 214, 216 a reference position on the photosensitive drum, 205, 211, 212 and 213 reflecting mirrors to lead reflected light from the image original 201 to the photosensitive drum 214 along the light path 214, 210 a reciprocating optical system including the light sources 206, 207, the reflecting mirrors 208, 209, and the separate reflecting mirror 205, 203 a sensor to detect a home position (or starting position) of the optical system 210, 204 a sensor to detect a reversing position of the optical system 210, 229 a lens system having an aperture mechanism and a magnification changing (zooming) function, 228 an electric motor to rotate the photosensitive drum 214, 219 an optical system reversing and forwarding clutch to connect the photosensitive drum motor 228 with the optical system 210 so as to move the optical system 210 in the direction of an arrow 225 and to move the optical system 210 in the direction of an arrow 226 at a different speed, 217 a drive mechanism to select one of clutches 219 to 223 and convert a predetermined rotation thereof into the movement of the optical system in the arrowed directions 225 and 226, 227 a prerunning portion of the optical system 210, and 232 a sensor to detect the predetermined portion or the reference position 216 of the photosensitive drum 214 (hereinafter referred to as "home position").

In the following, the process steps for forming an electrostatic latent image on the photosensitive drum 214 will be explained. First of all, a reproduction start signal causes the photosensitive drum 214 to rotate, the electromagnetic clutch 219 is simultaneously actuated, and the optical system 210 returns to its home position and reaches the position of the sensor 203 to stop. Subsequently, when the home position 216 of the photosensitive drum 214 reaches the sensor 232, the surface of the photosensitive drum 214 is uniformly charged by a corona charger (not shown). When the photosensitive drum 214 rotates for a predetermined angle, and the charged surface reaches a position where a reflected image of the image original 201 is incident, one of the electromagnetic clutches 220, 221, 222, and 223 is actuated, and the optical system 210 moves in the direction of an arrow mark 226 to start the exposure scanning. Thereafter, the exposure scanning is conducted in such a manner that the reflected image at the tip end 230 of the image original 201 may coincide with the position 231 on the photosensitive drum 214, and when the optical system 210 passes through the tip end position 230 of the image original 201, the exposure scanning is conducted at a stable speed in synchronism with the photosensitive drum 214. When the optical system 210 arrives at the sensor 204 which is a reversing position thereof, it stops the exposure scanning, and returns in the arrow direction 225. Thereafter, the electrostatic latent image thus formed is developed, transferred onto an image bearing member such as paper fed from a paper feeding cassette, and finally image-fixed to complete the reproduction operation.

Figure 12:
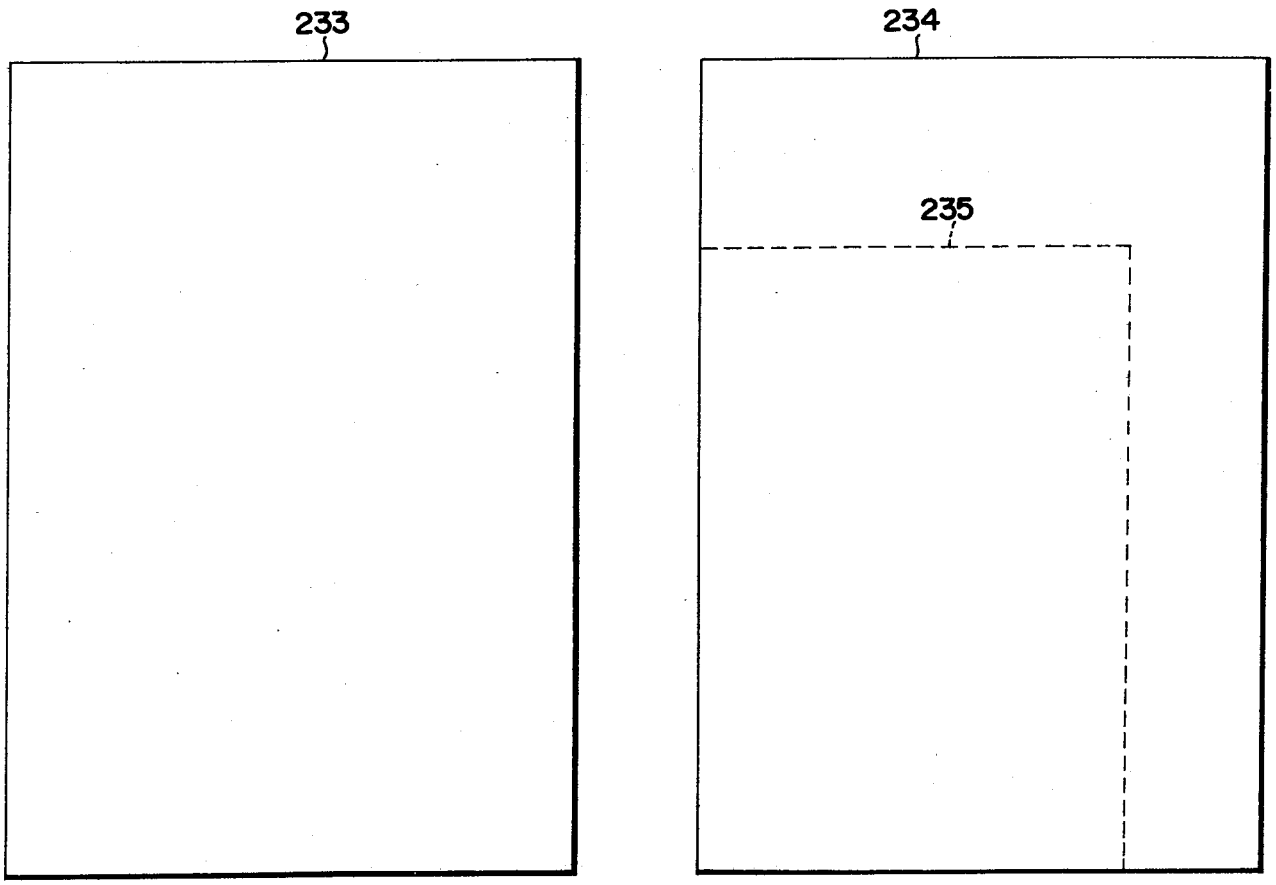
FIG. 12 is a plan view showing size of an image original and sizes of reproduction paper.
Figure 13:
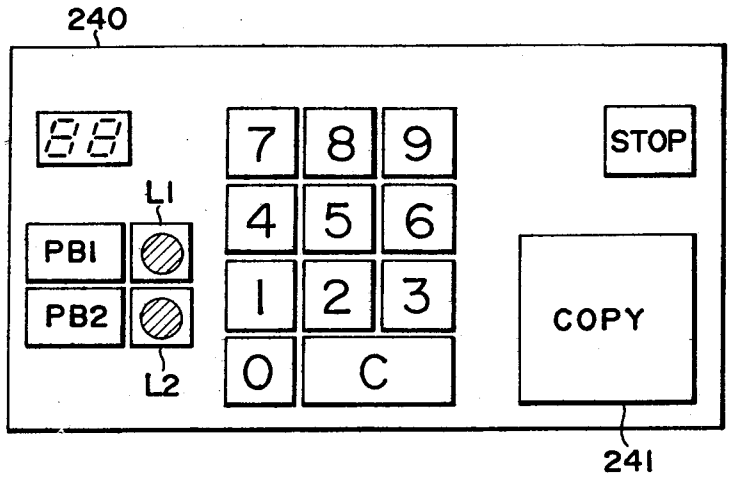
FIG. 13 is a top plan view of an operating panel in the reproduction apparatus shown in FIG. 11.
Figure 14:
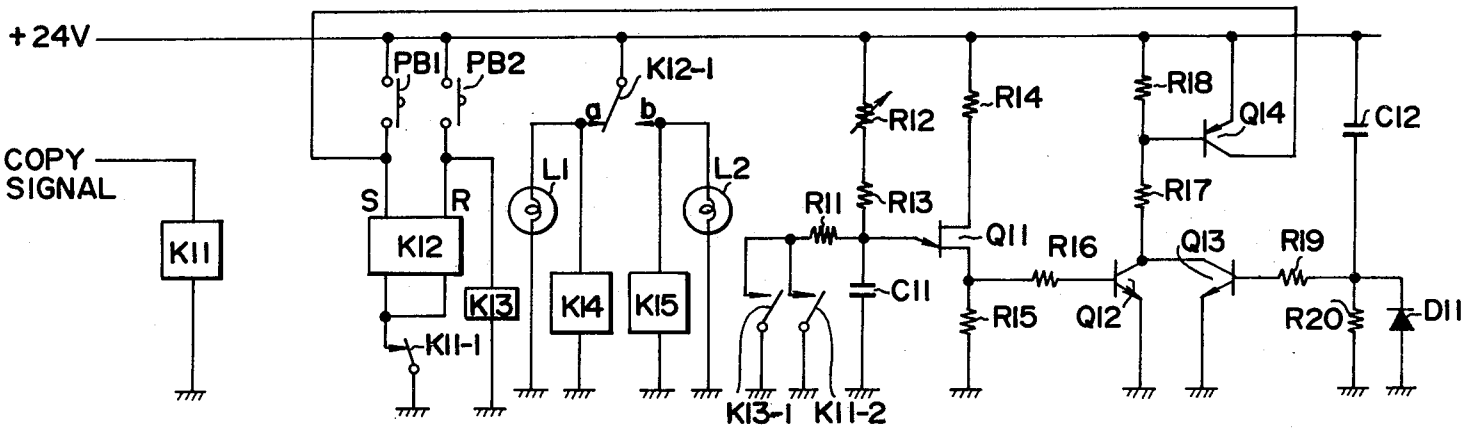
FIG. 14 is a diagram showing a control circuit for image magnification change-over in the reproduction apparatus shown in FIG. 11.
Figure 15:
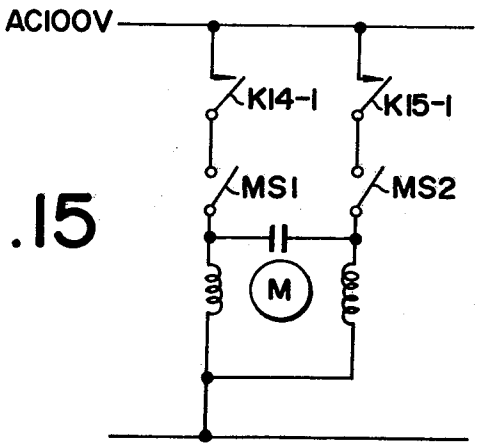
FIG. 15 is a circuit diagram for a driving section of a lens system.
Figure 16:
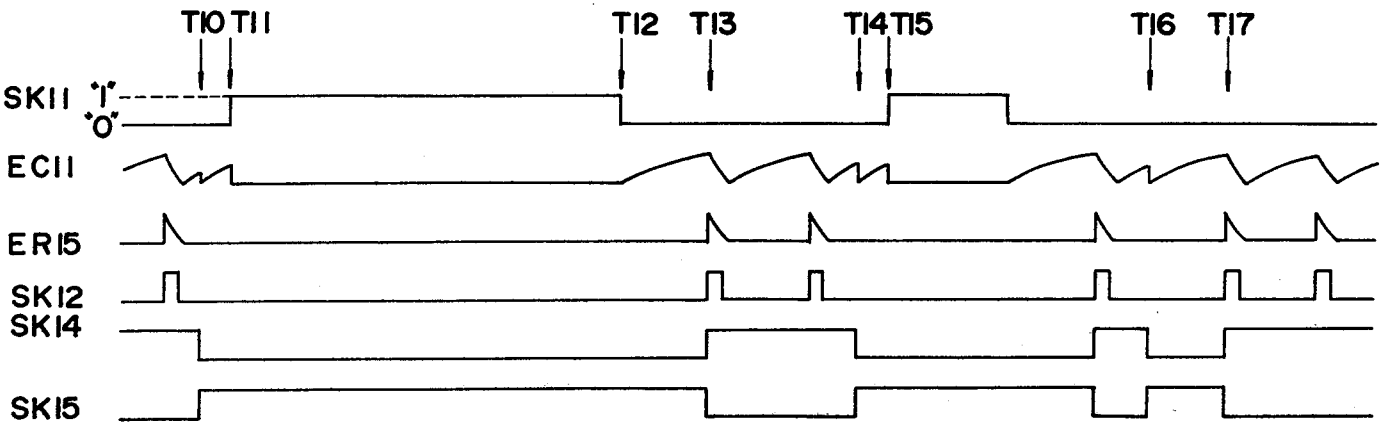
FIG. 16 shows various signal waveforms in every part of the circuit shown in FIG. 14.

Next, explanations will be given as to the case of reproduction with varying image magnification. Here, the reproduction is conducted with two kinds of paper size, as shown in FIG. 12, i.e., the one is a paper size 234 which is equal to an image original 233, and the other is a paper size 235 which 1/n of a size of the image original 233. In the case of the equal size reproduction, the scanning speed of the optical system 210 may be equal to the peripheral speed of the photosensitive drum 214. In the case of the reduced size reproduction, however, the scanning speed of the optical system 210 is required to be faster than the peripheral speed of the photosensitive drum 214. In addition, it is necessary that the lens system 299 be shifted to a position shown by a dash line 229' to perform a size-reduction zooming operation. Since the control method for this operation is not the subject matter of the present invention, detailed explanation thereof will be dispensed with.

In the following, change-over operations of the reduced size reproduction and the equal size reproduction will be explained in detail in reference to FIGS. 13, 14, 15 and 16. In the drawing, a reference symbol PB1 designates a push button switch for instructing the equal size reproduction, PB2 a push button switch for instructing a reduced size reproduction, 241 a copy button, L1 a display lamp for the equal size mode, L2 a display lamp for the reduced size mode, K11 a relay for holding a copy signal SK11, and K12 a latching relay. By the relays K11 and K12, an equal size mode instructing relay K14 or a reduced size mode instructing relay K15 is selected. Reference symbols MS1 and MS2 are micro-switches shown in FIG. 11, M a lens system driving motor, EC11 a terminal voltage of a capacitor C11, ER15 a terminal voltage of a resistor R15, SK12 a pulse input signal of a winding S of the above-mentioned relay K12, SK14 a pulse input signal to the relay K14, and SK15 a pulse input signal to the relay K15.

When the switch PB1 is depressed, a voltage is applied to the winding S of the latching relay K12, and a contact K12-1 thereof is connected to the side a. (Since K12 is the latching relay, it maintains its original condition, even when the excitation is removed.) By this connection, the lamp L1 is turned on to notify the operator. At the same time, the relay K14 is turned on, the motor M rotates in the clockwise direction, the lens system 229 moves rightward to push the micro-switch MS1, and the motor M stops at the equal size position. Also, the optical driving device 217 selects the forward driving clutch at the equal size reproduction by a control circuit (not shown), whereby preparation for the equal size reproduction is completed.

When the reduced size switch PB2 is depressed, a voltage is applied to the winding R of the relay K12, and the contact K12-1 is connected to the side b to turn on the reduced size display lamp L2. At the same time, the relay K15 is turned on to rotate the motor M in the counter-clockwise direction, the lens system 229 moves leftward to reach a reduced size position shown by a dash line 229' to push the micro-switch MS2 and stops. Also, the optical system driving device 217 selects the forward driving clutch at the time of the reduced size reproduction by a control circuit (not shown), whereby preparation for the reduced size reproduction is completed.

In the following, operations of the control circuit when the copy button 241 is depressed subsequent to depression of the reduced size switch PB2 will be explained. At a time instant $T_{10}$ in FIG. 16, the abovementioned switch PB2 is depressed, and, at a time instant $T_{11}$, the copy button 241 is depressed, whereupon the reproduction operation starts in the reduced size mode, the copy signal SK1 assumes a level "1", the relay K11 is turned on, and the contact K11-1 is opened. As the result, the relay K12 does not operate even when the switch PB1 is depressed. In other words, there is created a change-over prohibiting condition. On the other hand, since the other contact K11-2 of the relay K11 is closed, the capacitor C11 is not charged. When the reproduction terminates at a time instant $T_{12}$, the copy signal SK11 assumes a level "0", the relay K11 is turned off, the contact K11-1 is closed, and the abovementioned change-over prohibiting condition is released to enable the change-over operation to be effected. At the same time, the contact K11-2 is opened, and electric charging to the capacitor C11 begins through the resistor R12 and R13. The charging circuit constructed with the resistors R12 and R13 and the capacitor C11 is connected with the emitter of UJT Q11. At a time instant $T_{13}$, i.e., when the voltage of the capacitor C11 becomes $24 \times Y$ [V], where Y is an open voltage ratio, a resistance between the base and the emitter of UJT Q11 becomes low, whereby electric charge of capacitor C11 is discharged through the resistor R15, and a voltage is generated in the resistor. This is a well known oscillating circuit, the oscillation period of which is adjustable by the variable resistor R12. Here, it is selected in a range of from 30 to 60 seconds or so. An oscillating output of this oscillation circuit stands for a voltage to be applied to the resistor R15. This output is amplified by the transistors Q12 and Q14 and introduced as an input into the winding S of the relay K12. In other words, the winding S of the relay K12 is excited at the time instant $T_{13}$ after lapse of 30 to 60 seconds from the time instant $T_{12}$ when the reproduction operation is terminated, and the contact K12-1 is changed over to the side a to render the image magnification to be the equal size magnification. However, when the copy button 141 is again depressed during a period between the time instant $T_{12}$ and $T_{13}$, the reproduction operation is conducted in the reduced size mode. Further, after the image magnification has been changed over to the equal size magnification, when the switch PB2 is depressed at a time instant $T_{14}$, the relay K13 is turned on, whereby the contact K13-1 is closed only when the abovementioned switch PB2 is depressed, and the capacitor C11 is discharged. When the copy button 141 is depressed at a time instant $T_{15}$ with the image magnification remaining in the reduced size mode, there can be obtained a reduced size copy.

When the copy button 241 is not depressed during a period of 30 to 60 seconds after the switch PB2 is depressed at a time instant $T_{16}$ subsequent to change-over of the image magnification to the equal size mode, the abovementioned oscillation circuit again oscillates at a time instant $T_{17}$, and the winding S of the relay K12 is excited through the transistors Q12 and Q14, and the contact K12-1 is connected to the side a to be converted to the equal size magnification.

In the following, the operations of the circuit right after turning on of the power source switch will be explained. Right after turning on of the power source, it is not known whether the contact K12-1 of the relay K12 is at the side a, or at the side b. Accordingly, by using a time constant circuit consisting of resistors R9 and R10 and a capacitor C2, a transistor Q13 is actuated immediately after turning on of the power source to apply a pulse having a certain pulse width to the winding S of the relay K12 to set the image magnification at the equal size mode. Since the charge in the capacitor C12 right after turning on of the power source is zero, it is charged through the resistors R9 and R10. Until the charging operation completes, the transistor Q13 continues its operation. Also the transistor Q14 operates through the resistor R7. The collector current of the transistor Q14 flows through the winding S of the relay K12, whereby the contact K12-1 is connected to the side a, the relay K14 is turned on, and the equal size magnification mode is set. It is also possible that the image magnification be rendered equal size magnification after lapse of a certain time period subsequent to turning on of the power source. Moreover, in this electrophotographic reproduction apparatus, it is possible to change the size of the recording paper from the equal size magnification to reduced size magnification, or vice versa. Therefore, as soon the equal size magnification is set, the recording paper can be brought back to the size for the equal size magnification. This paper size changing control is done by actuating the paper feeding rollers for the cassette containing the paper for the equal size magnification with the abovementioned signal SK14, or by actuating the paper feeding rollers for the cassette containing the paper for the reduced size magnification with the signal SK15.

As explained in the foregoing, in the image magnification changing device such as image reproduction apparatus, etc., when no instruction for the image formation is given within a certain definite time period after the image formation in either a reduced size or enlarged size magnification mode, or after such image magnification mode has been selected, it is possible to automatically return the image magnification mode to the equal size magnification or to a state, wherein the operator performs the image formation with a magnification in ordinary use after the power source is turned on. Therefore, the operation can be simply performed for instruction of the image magnification mode which is not in ordinary use.

Figure 17:
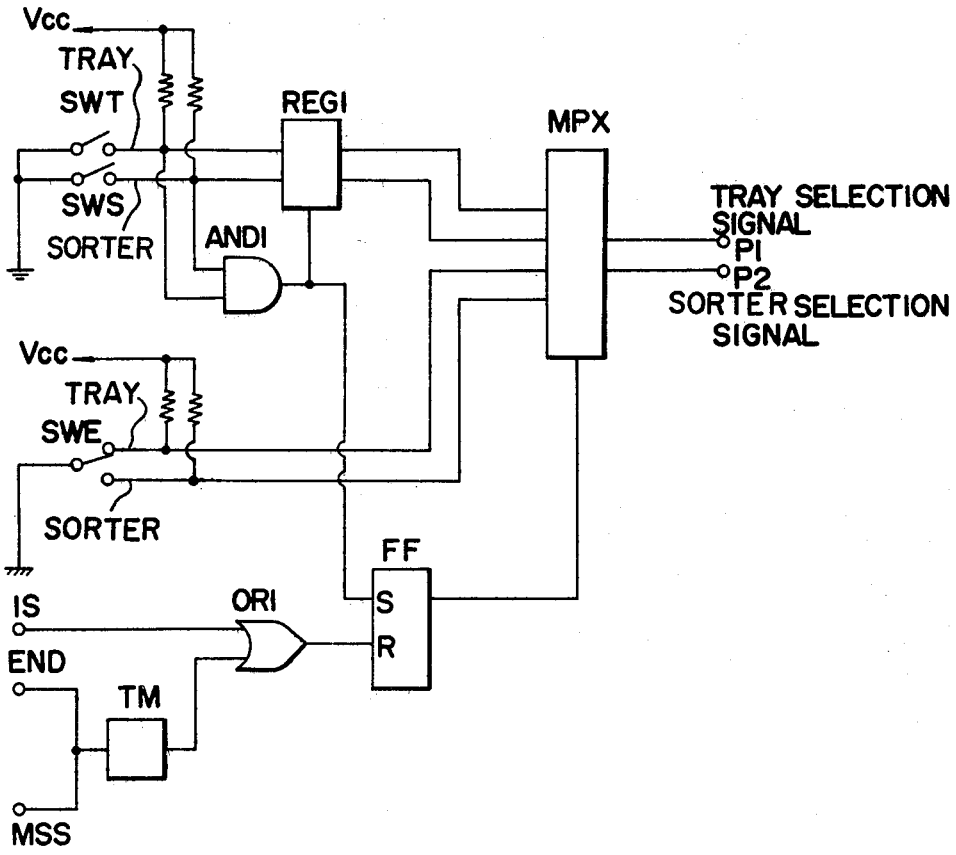
FIG. 17 is a control circuit diagram for changing over the standard operating modes.

In the above-described first, second and third embodiments, the standard mode to be returned after turning on of the power source, or termination of the image formation, or the mode designation is predetermined. This standard mode can also be changed depending on the condition of use by the operator. FIG. 17 shows a circuit for changing the standard mode, in which the discharging section of the image transfer paper is taken as an example. In the drawing, SWT refers to a tray selection switch, SWS a sorter selection switch, REG1 a register, AND1 an AND gate, MPX a multiplexer, FF a flip-flop circuit, OR1 an OR gate, TM a timer, and SWE a standard mode selection switch. When a power is supplied to the reproduction apparatus, an initial signal IS is generated from a circuit (not shown). When this initial signal IS is generated, the flip-flop FF is reset, and an output from this flip-flop functions to change over the interior of the multiplexer MPX. At this time, since the abovementioned standard mode selection switch has selected the tray, the tray selection signal is produced as an output from a terminal P1 into the reproduction apparatus. In this instance, when the standard mode selection switch has selected the sorter, a sorter selection signal output is produced from a terminal P2. When no reproduction is conducted with the standard mode as selected, the switches SWT and SWS are depressed to set the flip-flop FF and to change over the multiplexer MPX, whereby an output signal selected from the switches SWT and SWS can be produced from the terminals P1 and P2.

In the foregoing, explanations have been made as to a case wherein the initial signal IS has been produced as an output. Also, in the case of a copy terminating signal END and a mode selection signal MSS being produced as an output, the flip-flop FF is reset after a predetermined time has been counted, whereby the multiplexer MPX is changed over to the standard mode. In this way, by changing over the switch SWS, the standard mode can be obtained.

As stated in the foregoing, in the image forming device such as reproduction apparatus, etc. according to the present invention, when no instruction for the image formation is given within a certain definite time period after the image formation in a mode other than the predetermined standard mode, or after selection of the predetermined standard mode, or in the case of a particular state such as after turning on of the power source, etc., such predetermined standard mode can be set without necessity for the mode designation, and the operator can only effect the mode designation only when he conducts the image formation using a mode which is not ordinarily used. Further, even when the mode designation is foregotten, there is no possibility of an erroneous copy being made, because the predetermined standard mode in ordinary use is always established.

In the foregoing description, explanation have been made in reference to the image forming device capable of changing the image density, the image forming device having a plurality of paper feeding sections or paper discharging sections, and the image magnification changing device capable of effecting a plurality of image size magnifications. It should, however, be noted that the present invention is not limited to these embodiments, but any other image forming devices containing different image forming modes are all applicable for the purpose of the present invention.

What we claim is:

1. An image forming apparatus comprising:

means for forming an image on an image bearing member, said image forming means including magnification changing means for changing the magnification of the image to be formed;

magnification input means having an input key for designating the magnification;

a power source for driving said image forming means;

setting means for automatically setting, after said power switch is turned on, a standard magnification independently of said magnification input means;

first control means for prohibiting a change of the magnification by said magnification input means, once said image forming means starts the image forming operation thereof after the standard magnification is set by said setting means, and for allowing a change of the magnification by said magnification input means before the start of the image forming operation and after termination of the image forming operation; and second control means for controlling the image forming means to execute the image forming operation in accordance with the magnification determined by said input means and said setting means.

2. An image forming apparatus comprising:

image forming means for forming images on image bearing members;

a plurality of feeding stations for accommodating the image bearing members and feeding them to said image forming means;

a plurality of selection keys for selecting one of said feeding stations;

a power source for driving said image forming means;

automatic selection means for automatically selecting, after said power switch is turned on, a predetermined feeding station independently of said selection keys;

first control means for prohibiting a change of the selected feeding station by said selection keys, once said image forming means starts the image forming operation thereof after the predetermined feeding station is selected by said automatic selection means, and allowing a change of the selected feeding station by said selection keys before the start of the image forming operation and after termination of the image forming operation; and second control means for controlling the feeding stations so that the feeding station selected by said selection keys and said automatic selection means, feeds the image bearing member.

3. The image forming device as claimed in claim 2, wherein said plurality of paper feeding station accommodate therein different sizes of image bearing members for each paper feeding station.

4. An image forming apparatus, comprising:

means for designating one of a plurality of image forming conditions under which an image forming operation of an original is to be carried out;

means for forming an image of the original on an image bearing member;

a timer which starts its timing operation upon termination of the image forming operation;

means for resetting said timer in accordance with the operation of said image forming means and said designating means;

means for setting a predetermined one of said conditions, independently of said designating means, after said timer measures a predetermined time period; and control means for controlling the image forming means to execute the image forming operation under the condition determined by said designating means and said setting means.

5. The image forming device as claimed in claim 4, wherein said image forming means comprises the image magnification changing means to change the magnification of the image to be formed, said designating means comprises image magnification designating means to designate an arbitrary image magnification, and said setting means comprises standard image magnification setting means to set the image magnification to a predetermined standard magnification.

6. The image forming device as claimed in claim 4, wherein said image forming means is provided with an image forming section to form the image on said image bearing member and a plurality of paper feeding sections to forward said image bearing member to said image forming member, said plurality of paper feeding sections accommodate therein different kinds of image bearing members for each paper feeding section, said designating means designates an arbitrary paper feeding section out of said plurality of paper feeding sections, and said setting means comprises paper feeding setting means to set a predetermined paper feeding section.

7. The image forming device as claimed in claim 6, wherein said plurality of paper feeding sections accommodate therein different sizes of image bearing members for each paper feeding section.

8. An image forming apparatus, comprising:

means for holding an original;

means for designating one of a plurality of image forming conditions under which an image forming operation of an original is to be carried out;

means for forming an image of the original on an image bearing member;

a single timer which starts its timing operation in accordance with a condition setting other than termination of the image forming operation and other than a predetermined condition setting by said designating means;

means for changing, after a predetermined time period is measured by said timer, to the predetermined conditions of the plural conditions independently of said designating means; and control means for controlling the image forming means to execute the image forming operation under the condition determined by said designating means and said changing means.

9. The image forming device as claimed in claim 8, wherein said image forming means comprises image magnification changing means to change magnification of the image to be formed, said designating means comprises image magnification designating means to designate an arbitrary image magnification, and said change-over means comprises standard image magnification change-over means to change over the image magnification to a predetermined standard magnification.

10. The image forming device as claimed in claim 8, wherein said image forming means is provided with an image forming section to form the image on said image bearing member and a plurality of paper feeding sections to forward said image bearing member to said image forming section, said plurality of paper feeding sections accommodate therein different kinds of image bearing members for each paper feeding section, said designating means designates an arbitrary paper feeding section out of said plurality of paper feeding sections, and said change-over means comprises paper feeding section change-over means to change over the paper feeding section to a predetermined paper feeding section.

11. The image forming device as claimed in claim 10, wherein said plurality of paper feeding sections accommodate therein different sizes of image bearing members for each paper feeding section.

12. The image forming device as claimed in claim 4 or 8, wherein said predetermined condition is arbitrarily changeable.

13. An image forming device, comprising:

image forming means for forming an image on an image bearing member;

a plurality of feed paper storing sections for storing image bearing members of different sizes;

feeding means for feeding image bearing members to said image forming means from said plurality of feed paper storing sections;

feed paper storing section designating means for designating an arbitrary feed paper storing section, from which the image bearing members are fed;

timing means for starting a time count after said image forming means terminates the image formation with a feed paper storing section other than a predetermined feed paper storing section out of said plurality of feed paper storing sections designated by said feed paper storing section designating means;

change-over means for changing over said feed paper storing section into said predetermined paper storing section after said timing means counts a predetermined time; and means for prohibiting a change of the designated feed paper storing section by said designating means during the operation of said image forming means.

14. The image forming device as claimed in claim 13, wherein said predetermined time is changeable.

15. An image forming device, comprising:

image forming means for forming an image on an image bearing member;

a plurality of discharge sections for discharging the image bearing member on which an image has been formed by said image forming means;

discharge section designating means for designating an arbitary discharge section out of said plurality of discharge sections;

discharge section change-over means for changing over the discharge section so as to discharge the image bearing member into a predetermined discharge section out of said plurality of discharge sections independently of said discharge section designating means, when said image forming means is in a particular condition; and means for prohibiting a change of designated discharge section by said designating means during the operation of said image forming means.

16. The image forming device as claimed in claim 15, wherein said plurality of discharge sections consist of at least a tray and a sorter.

17. The image forming device as claimed in claim 15 or 16, further including a power source for driving said image forming means, and wherein said particular condition is that said power source is turned on.

18. The image forming device as claimed in claim 15 or 16, wherein said particular condition is that the image formation by said image forming means has been completed.

19. The image forming device as claimed in claim 15 or 16, further including timing means to perform a predetermined time counting after the designation of a discharge section other than said predetermined discharge section by said discharge section designating means, and wherein said particular condition is that said timing means has counted a predetermined time.

20. The image forming device as claimed in claim 15 or 16, wherein said predetermined discharge section is changeable.

21. The image forming device as claimed in claim 16, wherein said predetermined discharge section is a tray.

* * * * *